United States Patent [19]

Kleist et al.

[11] 4,177,731

[45] Dec. 11, 1979

[54] PRINTER SYSTEM RIBBON DRIVE HAVING CONSTANT RIBBON SPEED AND TENSION

[75] Inventors: Robert A. Kleist, Anaheim; Jerry Matula, Culver City, both of Calif.

[73] Assignee: Printronix, Inc., Irvine, Calif.

[21] Appl. No.: 889,290

[22] Filed: Mar. 23, 1978

Related U.S. Application Data

[63] Continuation of Ser. No. 708,364, Jul. 26, 1976, abandoned.

[51] Int. Cl.[2] ..... B41J 33/14

[52] U.S. Cl. ..... 101/336; 400/219.1; 400/225; 400/121

[58] Field of Search ..... 400/121, 219.1, 225; 101/336; 318/7

[56] References Cited

U.S. PATENT DOCUMENTS

| | | | |
|---|---|---|---|
| 3,079,538 | 2/1963 | Yamashita | 318/7 |
| 3,291,043 | 12/1966 | Bernard | 101/336 X |
| 3,334,585 | 8/1967 | Moran et al. | 101/336 |
| 3,354,822 | 11/1967 | Dollot | 101/336 |
| 3,384,796 | 5/1968 | Shah | 318/7 |
| 3,444,445 | 5/1969 | Mullin | 318/7 |
| 3,501,682 | 3/1970 | Jacoby | 318/7 |
| 3,606,201 | 9/1971 | Petusky | 318/7 X |
| 3,704,401 | 11/1972 | Miller | 318/7 |
| 3,715,641 | 2/1973 | Mattes | 318/7 |
| 3,733,529 | 5/1973 | Ross et al. | 318/7 |
| 3,836,831 | 9/1974 | Van Heelsbergen | 318/7 |
| 3,863,117 | 1/1975 | Paschetto | 318/7 |
| 3,870,934 | 3/1975 | Blood | 318/7 |
| 3,902,585 | 9/1975 | Mogtader | 400/225 X |
| 3,912,990 | 10/1975 | Kuhnlein et al. | 318/7 |
| 3,941,051 | 3/1976 | Barrus et al. | 400/121 X |
| 3,966,036 | 6/1976 | Bernardis et al. | 400/225 X |
| 4,000,804 | 1/1977 | Zaltieri | 400/225 X |

OTHER PUBLICATIONS

IBM Technical Disclosure Bulletin, "Reel-to-Reel Tape Unit with Decreased Acceleration Time," Kollar et al., vol. 14, No. 8, Jan. 1972, pp. 2331, 2332.

*Primary Examiner*—Ernest T. Wright, Jr.
*Attorney, Agent, or Firm*—Fraser and Bogucki

[57] ABSTRACT

An impact printer ribbon drive of the reel-to-reel type, in which a length of ink ribbon extending between and wound around opposite reels is disposed between a reciprocating hammer bank and print paper on a platen, drives the ribbon at substantially constant speed and tension independent of varying ribbon pack diameter on the two reels. Each one of the reels is driven by a different one of a pair of DC permanent magnet motors. The motors are energized by a circuit which maintains the sum of the currents through the two motors substantially constant and which also maintains the voltage at the leading or take-up motor substantially constant. The sum of the currents and the voltage are maintained substantially constant by a pair of servo circuits associated with different ones of the motors and coupled to be alternately actuated in response to external direction commands. Also included is circuitry responsive to voltages in different parts of the circuit for signalling unwanted conditions such as a run-away ribbon, a jammed ribbon or a loose hub at one of the reels.

18 Claims, 5 Drawing Figures

PRINTER SYSTEM RIBBON DRIVE HAVING CONSTANT RIBBON SPEED AND TENSION

This is a continuation of application Ser. No. 708,364, filed July 26, 1976, now abandoned.

BACKGROUND OF THE INVENTION

1. Field of the Invention

The present invention relates to systems for driving an elongated web member between a pair of rotatable reels, and more particularly to systems for driving an ink ribbon between opposite reels in an impact printer.

2. History of the Prior Art

It is known to provide impact printers in which the individual hammers of a hammer bank are employed to impact an ink ribbon against print paper supported by a platen to effect printing. The printing may be formatted in different ways such as in dot matrix fashion where the desired characters or other printed indicia are comprised of a series of point like marks made by the impacting hammers. The hammer bank may be reciprocated relative to the print paper to optimize usage of the hammers. At the same time the ink ribbon which is typically mounted by an opposite pair of rotating reels may be driven in opposite directions between the opposite ends thereof to equalize usage and wear thereof.

One example of an impact printer system of the type described is provided by U.S. Pat. No. 3,941,051, Barrus et al, PRINTER SYSTEM, issued Mar. 2, 1976 and assigned to the assignee of the present application. In the impact printer system of U.S. Pat. No. 3,941,051 the opposite ribbon reels are driven by a pair of AC motors, one of which serves as the leading or take-up motor. The trailing or supply motor is coupled to operate as a torquer which exerts constant torque. Because the diameter of the ribbon pack varies as the ribbon is driven from one reel to the other, the constant speed of the leading motor results in proportional variation in the speed of the ribbon. For example, the speed will typically double as the ribbon pack diameter is doubled for constant rotational speed of the leading motor. Similarly, the torquer motor causes ribbon tension to vary inversely with the diameter of the ribbon pack on the reel connected to the torquer motor. Ribbon tension also varies with variations in the line voltage. There is a further tension variation at the print positions caused by the fact that the torquer motor can be either at the leading or trailing end of the ribbon depending upon ribbon direction, and tension drop around the fixed guides for the ribbon can either add to or subtract from tension as determined by the torquer motor. Because the leading motor and the torquer motor are physically two different type devices, it is not feasible to interchange their role when the direction of ribbon drive is reversed.

Further problems may arise in cases where the hammer bank prints while moving in both directions relative to the print paper. For maximum duty cycle printing there is a narrow speed range that will allow printing on a new ribbon section for both directions. However, in the absence of precise speed control on the ribbon, dense printing such as "all black" produces horizontal shading when the ribbon travels in one direction at a speed below the required level. Further problems arise from the fact that it is difficult to provide a reliable fault sensor for the ribbon path which will indicate failure of the ribbon drive or ribbon.

Driving of the ribbon at other than a constant speed results in non-uniform wear which greatly shortens the useful life of the ribbon. Variations in ribbon tension detract from optimum guiding of the ribbon around the fixed guides that are preferably used. Excessive tension causes the edges of the ribbon to curl or fold over themselves at the guides. Too little tension often results in a tendency of the ribbon to fold over itself in the region where it drags against the print paper. A further disadvantage in the non-uniform ribbon speed of conventional ribbon drive systems relates to the inability to minimize print on overlapping parts of the ribbon as it makes each pass by the print head.

Accordingly, it would be desirable to provide a ribbon drive system which drives the ribbon at substantially constant speed independent of the varying ribbon packs on the rotating reels.

It would furthermore be desirable to provide a ribbon drive system which maintains substantially constant tension in the ribbon independent of varying ribbon packs on the reels.

It would furthermore be desirable to provide a ribbon drive system which does not require tachometers or similar means for sensing ribbon velocity or tension, which provides a fault signal in the event the ribbon breaks, is unsecured to the spool, or the drive is stalled, and which reverses the roles of the two different motors as ribbon direction is reversed so as to achieve substantially constant ribbon speed and tension and the other desirable characteristics when driving the ribbon in either direction.

BRIEF DESCRIPTION OF THE INVENTION

Ribbon drive systems according to the invention drive the ribbon at substantially constant speed and tension independent of the varying ribbon packs on the reels using a pair of direct current permanent magnet motors coupled to the reels and a circuit which maintains the sum of the currents through the two motors substantially constant and the voltage at the motor which is acting as the leading or take-up motor substantially constant. The speed-torque characteristic of a direct current permanent magnet motor has been found to approximate the required motor characteristic for a given speed and a given ribbon tension. The motor acting as the leading or take-up motor drives the ribbon at substantially constant speed independent of the ribbon pack thereon when the voltage drop thereacross is maintained substantially constant. The currents through the two different motors are found to vary in complementary fashion. If the current flow through the trailing or supply motor is varied so as to maintain the sum of the motor currents substantially constant the ribbon tension is maintained substantially constant independent of varying ribbon pack on the reels.

The DC permanent magnet motors are energized by a circuit having a pair of servo circuits which couple the motors between sources of constant voltage and a common current path and which are alternately actuated depending upon the desired direction of ribbon drive. The servo circuit associated with the motor acting as the leading or take-up motor is unactuated, effectively coupling the motor between the source of constant voltage and the common current path such that the voltage at the common current path reflects the voltage drop across the motor. The servo circuit associated with the trailing or supply motor and which is actuated responds to the voltage at the common current path by providing a current through the trailing or supply motor which maintains the voltage at the common current path substantially constant. In so doing the sum of the motor currents is maintained substantially constant, thereby resulting in constant ribbon tension as well as constant ribbon speed.

Various fault conditions are readily determined by sensing the voltage at the common current path. A run-away ribbon causes the servo circuit of the trailing motor to increase the motor voltage. This results in an increase in the voltage at the common current path which is detected and used to signal the run-away condition. Decreases in the voltage at the common current path are detected by circuitry which signals a loose hub condition which occurs when the leading or take-up reel is not securely fastened to its rotating hub. If the ribbon becomes jammed in its path between the reels a build-up of excess current in the leading motor servo circuit causes the output of the trailing servo circuit to be close to ground. This increases the current through the leading motor and thereby the voltage across a jam resistor coupled to the common current path. This voltage is detected so as to signal a jam condition.

BRIEF DESCRIPTION OF THE DRAWING

The foregoing and other objects, features and advantages of the invention will be apparent from the following more particular description of a preferred embodiment of the invention, as illustrated in the accompanying drawing, in which:

FIG. 5 is a detailed schematic diagram of one preferred arrangement of a ribbon drive in accordance with the invention.

DETAILED DESCRIPTION

Figure 1:
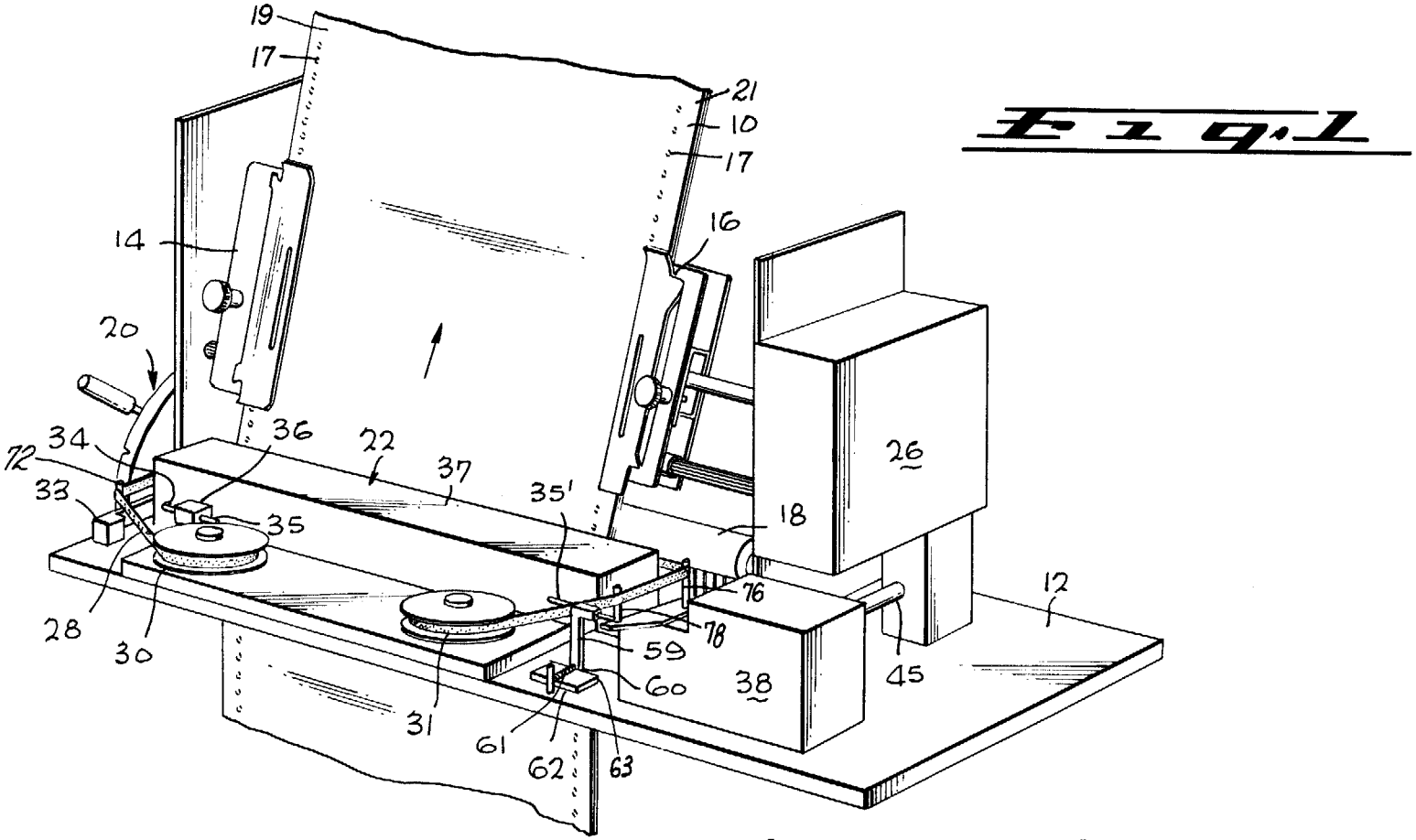
FIG. 1 is a perspective view of an impact printer system employing a ribbon drive in accordance with the invention.

For purposes of illustration and explanation ribbon drives in accordance with the invention are described in conjunction with a particular impact printer system shown generally in FIG. 1 and described in detail in previously referred to U.S. Pat. No. 3,941,051. However, it will be understood by those skilled in the art that the ribbon drives can be used with other printer systems as well as in environments where an elongated web member other than an ink ribbon is desirably driven at constant speed and with constant tension.

Figure 2:
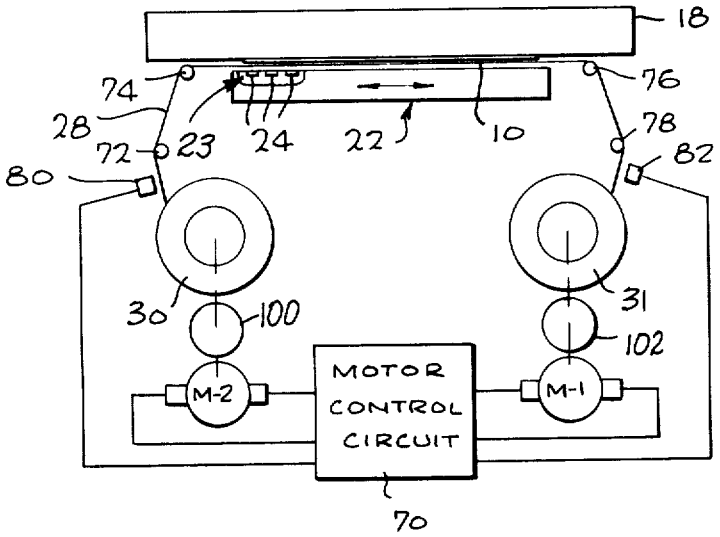
FIG. 2 is a combined plan view and block diagram of the ribbon drive of the system of FIG. 1.

The printer shown in FIG. 1 and described more fully in U.S. Pat. No. 3,941,051 comprises a 132 column page printer for data processing systems, operating typically at about 300 lines per minute and printing an original and a substantial number (e.g. 5) of clear carbon copies. The principal mechanical elements of the printer are shown in FIGS. 1 and 2. The paper or other imprintable media 10 comprises one or a number of webs of conventional edge perforated, continuous or fan-folded sheet fed upwardly through a base frame 12 and past a horizontal printing line position at which printing takes place. The original and carbon sheets are advanced together past the printing line by known tractor drives 14, 16, engaging edge sprocket perforations 17 along the two margins 19 and 21 of the paper 10. Just below the printing line, the paper 10 is held flat, under controlled tension and in registration, without entrapped air pockets against a platen 18, by a paper thickness adjustment control 20.

At the printing line, a shuttle mechanism 22 includes a hammer mechanism which is horizontally reciprocated to span a desired number of character column positions. This example assumes that there are to be 132 character positions or columns across the paper 10, and a bank 23 of 44 hammers 24 is employed, with the lateral travel of the shuttle mechanism 22 thus being sufficiently wide (0.3 inch in this example) for each hammer 24 to move across three different adjacent columns. In FIG. 2 the shuttle mechanism 22 is partly broken away to reveal several hammers 24. Each of the hammers 24, when actuated, moves forward under spring tension causing an included printing tip to impact an ink ribbon 28 against the paper 10 long enough to cause the impression of the printing tip to print on the paper 10, following which the hammer 24 returns to its initial position. Both 5×7 and 9×7 dot matrices are now widely used to define characters in dot printing systems. The hammers 24 are operated concurrently during the reciprocating motion to write selectively spaced dots within a horizontal dot matrix line in each of the three associated columns for each hammer 24. The paper 10 is then advanced by a stepping motor mechanism 26 to the next horizontal matrix line position. Thus the system concurrently writes different character segments in serial dot row fashion, first in one direction and then in the other.

At the printing line position, the ribbon 28 is interposed between the shuttle mechanism 22 and the paper 10, the ribbon 28 being advanced by supply and take-up reels 30, 31. Vertical shuttle support elements 33 mounted on the base frame 12 include linear bearings 34 for receiving horizontal support shafts 35, 35'. The shafts 35, 35' are coupled by brackets 36 to a horizontal channel member defining a housing 37 for the shuttle mechanism 22.

The hammer mechanism within the shuttle mechanism 22 is reciprocated by a cam assembly 38 described in detail U.S. Pat. No. 3,941,051. A rotatable cam follower engages the periphery of a double lobbed cam which is rotated by a shaft 45 coupled to a fly wheel and drive system (not shown). On the opposite side of the cam from the first cam follower, and in axial alignment therewith, a second rotatable cam follower also engages the cam periphery. The second cam follower is mounted within a counterweight structure rotatable about an axis substantially parallel to the axis of the shaft 45. The second cam follower is spring biased into constant engagement with the cam.

For ease of feeding the paper 10 past the printing line position, the shuttle mechanism 22 is pivotally rotatable about the off-axis support shafts 35, 35' at the brackets 36. However, the shuttle mechanism 22 is normally held at its printing position under the force exerted by a tension spring 61 coupling a dependent bracket 59 on the shaft 35' to the frame 12. A limit stop position for the bracket 59 is defined by engagement of a friction bearing element 60 against a linear surface 63 defined by a reference member 62 mounted on the frame 12. The entire shuttle mechanism 22 can therefore pivot about the axis of the shafts 35, 35' away from the printing line position so as to provide greater clearance between the hammer tips and the facing paper 10 to gain access to the hammer mechanism for cleaning.

As the shuttle mechanism 22 reciprocates back and forth to effect printing, the ribbon 28 is driven past the paper 10 and the platen 18, first in a direction from the reel 30 to the reel 31, and then in the reverse direction from the reel 31 to the reel 30. Each time the ribbon 28 is unwound to its end on one of the reels 30, 31, the condition is sensed and the direction of drive is reversed. In this manner usage and wear of the ribbon 28 are distributed throughout the entire length of the ribbon 28, while at the same time fresh portions of the ribbon 28 are constantly available for the various hammers 24 as they impact the ribbon 28 against the paper 10.

As shown in FIG. 2 the trailing or supply reel 30 is driven by a trailing or supply motor M2. The leading or take-up reel 31 is driven by a leading or take-up motor M1. The motors M1 and M2 are driven by a motor control circuit 70. The ribbon 28 extends from the supply reel 30 over a pair of fixed guides 72 and 74. From the fixed guide 74 the ribbon 28 extends between the shuttle mechanism 22 with its included hammers 24 and the paper 10 supported by the platen 18. At the opposite end the ribbon 28 extends over a pair of fixed guides 76 and 78 from which it is wound onto the take-up reel 31.

As previously noted the shuttle mechanism 22 undergoes reciprocal motion relative to the paper 10 and the platen 18 to enable each of the hammers 24 to print in a plurality of different column positions. At the same time the ribbon 28 is advanced from the supply reel 30 to the take-up reel 31 under the control of the motors M2 and M1 and the motor control circuit 70. The ribbon 28 is inclined at a small angle so as to be diagonally disposed relative to the print line position across the shuttle mechanism 22, the paper 10 and the platen 18. The ribbon 28 slopes downwardly from left to right so that the print line begins at the lower edge of the ribbon 28 at the left hand extreme and terminates at the upper edge of the ribbon 28 at the right hand extreme. This optimizes use of the surface area of the ribbon 28. When the ribbon 28 is completely wound upon the take-up reel 31, a sensor 80 responds to an embedded wire or other appropriate means within the end of the ribbon 28 at the supply reel 30 to provide a signal to the motor control circuit 70 which causes the motors M1 and M2 to reverse direction. The reel 30 then becomes the take-up reel and the reel 31 becomes the supply reel with the ribbon 28 moving in a direction from right to left. The ribbon 28 continues being driven in the direction from right to left until completely wound upon the reel 30. At this point a sensor 82 associated with the reel 31 senses the end of the ribbon 28 and provides a signal to the motor control circuit 70 to reverse the direction of the motors M1 and M2. Thereafter, the system proceeds to drive the ribbon 28 in a direction from left to right with the reel 30 functioning as the supply reel and the reel 31 functioning as the take-up reel as previously described.

Although the ribbon drive system shown in FIG. 2 is bidirectional in nature, the reels 30 and 31 are respectively designated supply and take-up reels not only for reasons of identification but also because of the fact that in typical prior art ribbon drive systems the motors M1 and M2 are different from one another and are designed to function as leading or take-up and trailing or supply motors respectively. In such prior art systems the motors M1 and M2 comprise AC motors with the leading motor M1 operating at constant speed and the trailing motor M2 connected to operate as a torquer so as to exert constant torque. The motor M1 normally overcomes the torque of the motor M2 to drive the ribbon 28 in a direction from left to right. Driving of the ribbon 28 in the reverse direction from right to left is accomplished by energizing the motor M1 so as to allow the torque of the motor M2 to overcome it.

Each time one of the hammers 24 impacts the ribbon 28 against the paper 10, the ink in the impacted area of the ribbon 28 is transferred onto the paper 10 leaving the impacted area of the ribbon 28 without ink until fresh ink flows into the impacted area from adjacent areas. For a given printer having hammers 24 of known speed and size, an optimum ribbon speed can be determined at which the printing will be uniformly dark for relatively dense printing demands such as "all black" printing. Moreover, it is highly desirable that the ribbon 28 be driven at a constant speed so as to prolong the life of the ribbon 28, and particularly to facilitate proper movement of the ribbon 28 over the fixed guides 72, 74, 76 and 78.

The wear characteristics of the ribbon 28 and the proper guiding thereof are also heavily dependent upon ribbon tension. Tension which is too high or too low causes the edges of the ribbon 28 to curl or fold over on themselves as they move over the fixed guides 72, 74, 76 and 78. Tension which is too great causes excessive wear of the ribbon 28. Tension which is too small invites the ribbon 28 to catch or jam in the relatively small space between the shuttle mechanism 22 and the paper 10. Accordingly, it is desirable that the ribbon 28 be driven at a constant tension of desired value.

Those prior art systems employing AC motors to drive the reels 30 and 31 attempt to provide constant ribbon speed of desired value and constant ribbon tension of desired value by operating the leading motor M1 at constant speed and the trailing motor M2 at constant torque. However, because the ribbon packs on the reels 30 and 31 vary so as to provide a changing diameter of as much as 2:1 or greater, ribbon speed and tension vary accordingly. Reel drive systems in accordance with the present invention drive the ribbon 28 at a constant selected speed and a constant selected tension independent of the varying ribbon packs on the reels 30 and 31. This is accomplished by use of DC permanent magnet motors as the motors M1 and M2 in conjunction with a motor control circuit 70 which varies the current through the trailing motor so as to maintain the voltage drop across the leading motor substantially constant and the sum of the currents through the motors M1 and M2 substantially constant.

In the example of the printer system shown in FIG. 1 the optimum ribbon speed has been found to be approximately 4.5 inches per second (ips) and the optimum ribbon tension has been found to be approximately 14 ounces. The speed of either motor M1 and M2 determines the speed of the associated rel 31 and 30 respectively. Neglecting losses due to motor friction and friction on the ribbon guides, the speed $V_R$ of the ribbon 28 at either reel 30 or 31 which is determined by the speed $V_M$ of the associated motor M2 or M1 and the radius r of the ribbon pack on the reel 30 or 31 is expressed by the equation:

$$V_M=(V_R/2\pi r)\times 60 \text{ (rpm)}$$

Likewise the torque $T_R$ on the ribbon 28 at either reel 30 or 31 depends on the torque $T_M$ of the associated motor M1 or M2 and the radius r of the ribbon 28 on the reel 30 or 31 and can be expressed by the equation:

$$T_M = T_R r \text{ (oz.-in.)}$$

Combining the two equations:

$$V_M = V_R T_R 60/2\pi T_M$$

If the optimum ribbon speed of 4.5 ips and the optimum ribbon tension of 14 oz. are substituted in the equation, then:

$$V_M = (4.5 \times 14 \times 60)/2\pi T_M = (602/T_M)$$

The equation $V_M = 602/T_M$ expresses the relationship of motor speed to motor torque to provide a ribbon speed of 4.5 ips and a ribbon tension of 14 ounces. This equation is represented by a hyperbolic curve 90 shown in FIG. 3.

A first point 92 on the curve 90 corresponds to a ribbon pack radius r of 1" which corresponds to the empty reel condition in the present example. A second point 94 on the curve 90 corresponds to the maximum ribbon pack or full reel condition in which the ribbon pack radius r is 1.9". Ideally, then, a constant ribbon speed of 4.5 ips and a constant ribbon tension of 14 ounces will be achieved through use of a motor M1, M2 whose torque-speed characteristic is identical to the portion of the curve 90 between the points 92 and 94. An AC motor is totally inappropriate since its torque-speed characteristic is a horizontal line on the plot of FIG. 3. However, the torque-speed characteristic for a DC permanent magnet motor driven by a constant voltage is a diagonal line extending from a maximum speed on the Y axis for the no-load condition when the torque is zero to a maximum torque on the X axis for the stall condition for which the speed is zero. Such a straight-line characteristic can be made to closely approximate the curve 90 between the points 92 and 94 by appropriate choice of parameters of the DC PM motor used. In the present example a size 12 motor provides the torque-speed characteristic 96 shown in FIG. 3. The point of maximum deviation of the characteristic 96 from the curve 90 which occurs midway between r=1" and R=1.9" results in variations in ribbon speed and tension of no greater than 12% which is far better than the 100% or greater variation occuring in prior art systems. The motor current characteristic for the DC PM motor of the present example is shown by the line 98 in FIG. 3.

Figure 3:
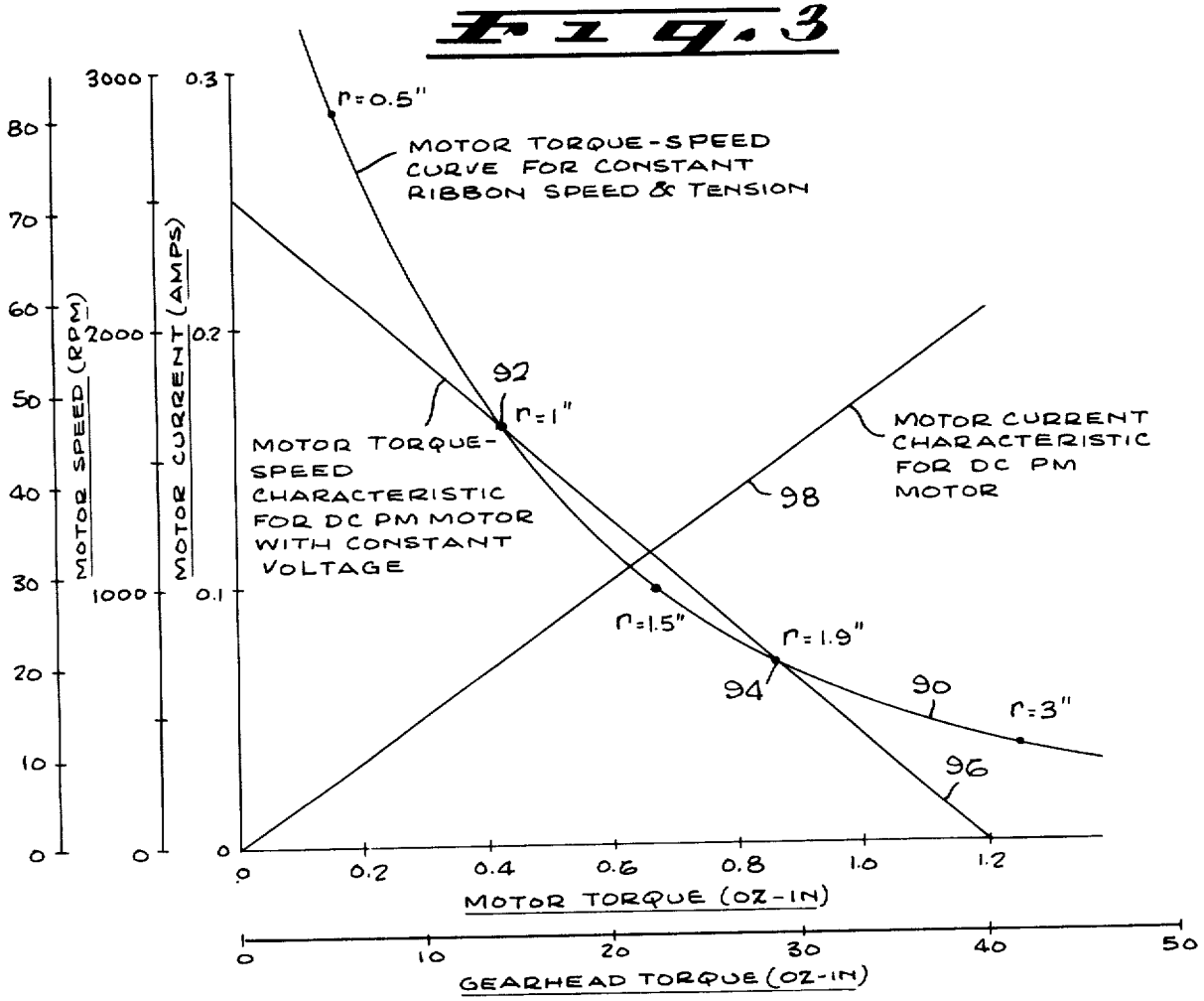
FIG. 3 is a diagrammatic plot of speed and current as a function of torque which is useful in explaining the manner in which the reel drive motors are chosen and driven in ribbon drives according to the invention.
Figure 3:
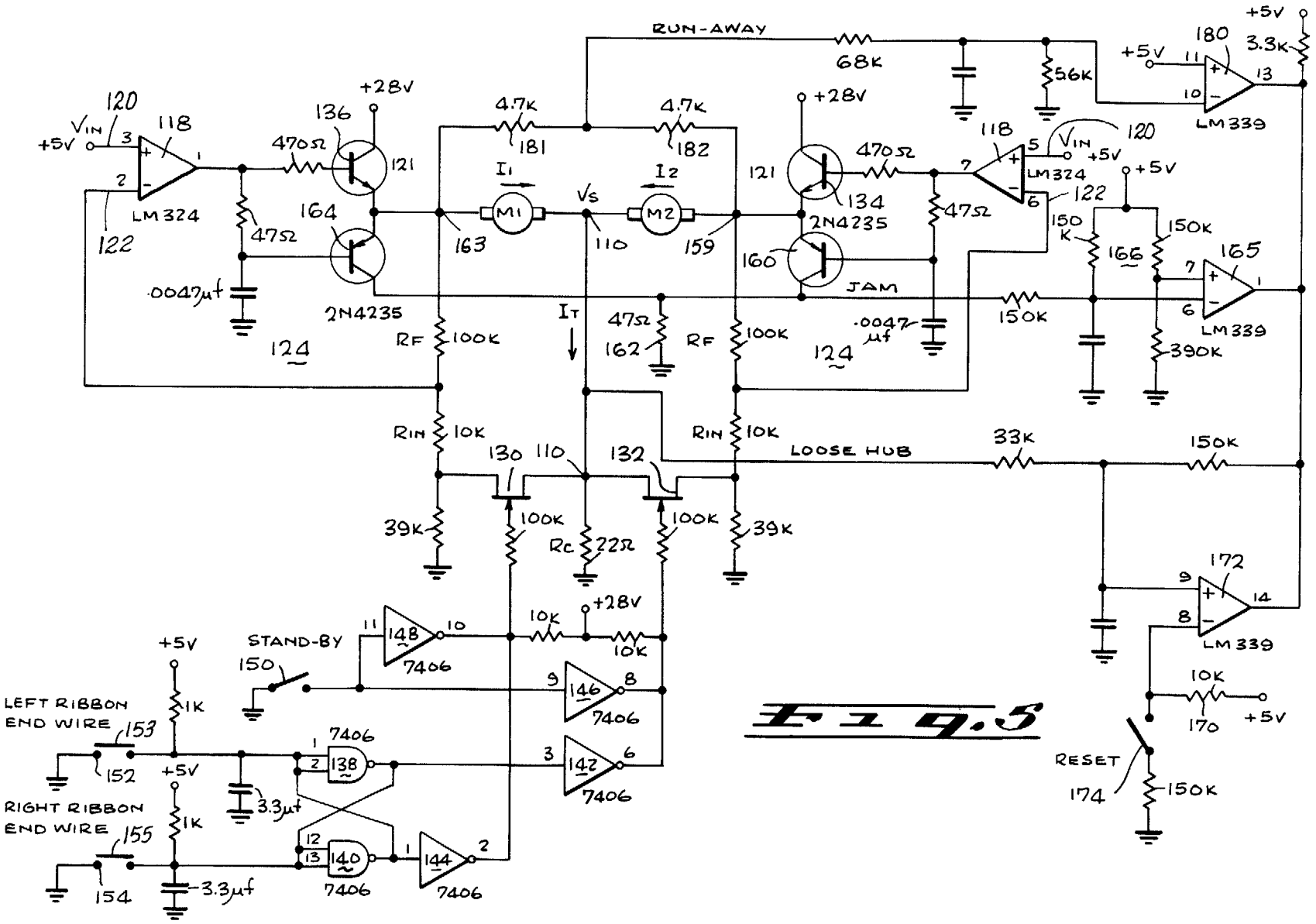

It will be noted that FIG. 3 has two different scales for speed and two different scales for torque. The speed scale designated "gearhead speed" and the torque scale designated "gearhead torque" correspond to the curve 90 and therefore dictate the speed and torque ranges which the motors M1 and M2 must be capable of producing. As a practical matter the required "gearhead torque" range would result in a motor of prohibitive size and expense. Consequently the size 12 DC permanent magnet motor is used in conjunction with a gearhead 100 or 102 having a gear ratio of 34.1:1. The desired torque is produced by the gearheads 100 and 102 and is represented by the "gearhead torque" scale in FIG. 3. Similarly, the desired speed range as provided by the gearheads 100 and 102 is represented by the "gearhead speed" scale in FIG. 3. The speed and torque at the input of the gearheads 100 and 102 as provided by the motors M2 and M1 is represented by the "motor speed" and "motor torque" scales in FIG. 3.

If DC permanent magnet motors are used as the motor M1 and M2 then the current I through either motor M1 or M2 is expressed by the equation:

$$I = T_M/K_T,$$

where $K_T$ is the motor torque constant. Since the gear ratio is 34.1 and the torque constant is $$5.43 \frac{\text{oz.-in.}}{\text{amp.}}$$

then the motor current for full ribbon pack of 1.9 inches is:

$$I = \frac{14 \text{ oz.} \times 1.9 \text{ in.}}{34.1 \times 5.43 \frac{\text{oz.-in.}}{\text{amp.}}} = 0.143 \text{ amp.}$$

Similarly, the motor current for an empty ribbon pack where r=1 in. is:

$$I = \frac{14 \text{ oz.} \times 1 \text{ in.}}{34.1 \times 5.43 \frac{\text{oz.-in.}}{\text{amp.}}} = 0.0755 \text{ amp.}$$

Since these values apply to both motors M1 and M2, and since the ribbon packs of necessity vary in complementary fashion, the currents through the two motors M1 and M2 also vary in complementary fashion, and in the present example will be 0.143 amp. + 0.0755 amp. or 0.2185 amp.

In order for the ribbon tension to remain constant the total torque of both motors M1 and M2 must remain constant. The torque of each motor M1 and M2 is proportional to the product of current and the motor constant $K_T$. If both motors M1 and M2 are the same, the total torque will be the product of the motor constant $K_T$ and the sum of the motor currents. It will therefore be seen that by maintaining the sum of the motor currents constant the total torque and therefore the ribbon tension will remain constant. By choosing a selected ribbon tension and maintaining the sum of the currents constant, the ribbon speed will be constant. Accordingly, constant ribbon speed and tension of selected values are achieved by driving the leading or take-up motor M1 with a constant voltage and the trailing or supply motor M2 with a current that maintains the sum of the two motor currents constant. Since the two motors M1 and M2 are identical, the roles of "leading motor" and "trailing motor" can be reversed for bidirectional ribbon drive.

Figure 4:
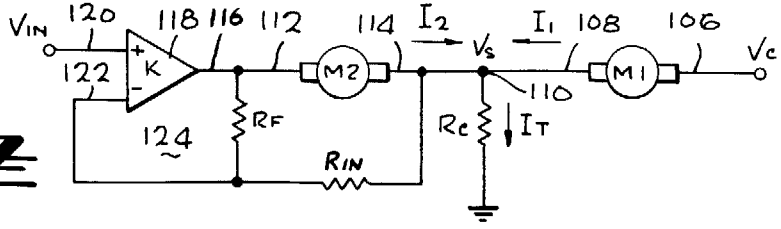
FIG. 4 is a block diagram of a ribbon drive in accordance with the invention.

A motor control circuit 70 for maintaining constant voltage at the leading motor M1 and the sum of the motor currents constant is shown in FIG. 4. The simplified circuit of FIG. 4 is designed for unidirectional ribbon drive and assumes that the motor M1 is the leading or take-up motor and that the motor M2 is the trailing or supply motor. The leading motor M1 has a pair of output terminals 106 and 108 respectively coupled to a constant voltage source $V_C$ and a common terminal 110 having a voltage $V_S$. The current $I_1$ through the motor M1 flows to the common terminal 110 together with the current $I_2$ through the motor M2. The currents $I_1$ and $I_2$ combine at the terminal 110 to form a total current $I_T$ which flows through a common current path comprising a resistor $R_C$ coupled between the common terminal 110 and ground. The motor M2 has a pair of opposite terminals 112 and 114 respectively coupled to the output 116 of a differential amplifier 118 and the common terminal 110. The differential amplifier 118 has a non-inverting input 120 coupled to a constant voltage source $V_{IN}$ and an inverting input 122 coupled to the output 116 through a feedback resistor $R_F$ and to the common terminal 110 via an input resistor $R_{IN}$.

The resistors $R_F$ and $R_{IN}$ combine with the differential amplifier 118 to form a servo circuit 124 which responds to the voltage $V_S$ at the common terminal 110 to provide a current $I_2$ through the motor M2 which maintains voltage $V_S$ constant and which combines with current $I_1$ to maintain current $I_T$ constant. The servo circuit 124 does this by functioning so as to tend to make the voltage $V_S$ at the common terminal 110 equal to the constant voltage $V_{IN}$. The differential amplifier 118 responds to feedback at its inverting input 122 by functioning so as to tend to make the voltage at the terminal 110 equal to voltage $V_{IN}$. As described hereafter in connection with FIG. 5 each of the motors M1 and M2 is preferably provided with one of the servo circuits 124 with the resulting pair of servo circuits 124 being alternately actuated for bidirectional operation. As also described in connection with FIG. 5 the circuit arrangement of the type shown in FIG. 4 is ideally suited for locating and identifying specific fault conditions using a minimum of circuitry. If the ribbon 28 becomes jammed along its path between the opposite reels 30 and 31 the trailing motor M2 provides a large negative current which results in an excessive voltage drop across the resistor $R_C$. This voltage condition at resistor $R_C$ is readily detected to signal a jam condition. If one of the hubs mounting the reels 30 and 31 is loose so that the reel 30 or 31 is not driven, the voltage drop across the resistor $R_C$ becomes very low. This voltage condition is also easily detected to signal a loose hub condition. During normal operation there is considerable difference between the voltages at the two motors M1 and M2. In the event the ribbon 28 breaks, however, both motors M1 and M2 operate under similar condition and the difference between the voltages thereof becomes very small. This condition is easily detected so as to signal a run-away condition.

FIG. 5 comprises a detailed example of a motor control circuit 70 according to the invention which includes a pair of alternately actuated servo circuit portions for facilitating bidirectional operation and circuitry for detecting voltage changes within the circuit to signal jam, loose hub and run-away fault conditions.

Referring to FIG. 5, the circuit 70 shown therein includes a pair of the servo circuits 124. The input resistor $R_{IN}$ of each servo circuit 124 is coupled to the common terminal 110 through a different one of a pair of field effect transistors 130 and 132. The field effect transistors 130 and 132 act as switches which are alternately opened and closed to alternately actuate the two different servo circuits 124. Thus, when the field effect transistor 130 is rendered conductive and the field effect transistor 132 is non-conductive, the motor M2 which acts as the leading motor is coupled directly to a constant voltage source by a transistor 134. At the same time the servo circuit 124 coupled to the motor M1 operates to maintain the voltage drop across the resistor $R_C$ constant as well as the total current $I_T$. When the conductivity of the transistors 130 and 132 is reversed, non-conduction of the transistor 130 results in coupling of the motor M1 directly to a constant voltage source via a transistor 136 to operate as the leading motor. At the same time the conducting transistor 132 activates the servo circuit 124 associated with the motor M2 so as to maintain the voltage drop across the motor M1 constant and the total current $I_T$ constant.

The field effect transistors 130 and 132 are operated by an input circuit responsive to the position of the ribbon 28 on the reels 30 and 31 and including a pair of circuits 138 and 140 comprising a flip-flop, and a plurality of buffers 142, 144, 146 and 148. The circuit 138 is coupled through the buffer 142 to the field effect transistor 132. Similarly, the circuit 140 is coupled through the buffer 144 to the field effect transistor 130. The buffers 146 and 148 are respectively coupled between the field effect transistors 132 and 130 and a stand-by switch 150. The circuit 138 is coupled to a switch 152 which grounds a 5 volt source via a wire 153 embedded in the left end of the ribbon 28 when the ribbon 28 is completely unwound from the left hand reel 30. This changes the state of the flip-flop comprised of the circuits 138 and 140 so as to ground the field effect transistor 132 via the buffer 142, thereby rendering the transistor 132 non-conductive and enabling the motor M2 to act as the leading motor. At the same time the field effect transistor 130 is rendered conductive, activating the servo circuit 124 associated with the motor M1 and enabling the motor M1 to operate as the trailing motor. When the ribbon 28 is completely wound upon the left hand reel 30 so that the ribbon pack on the right hand reel 31 is empty, a length of wire 155 buried in the ribbon 28 at the right hand end thereof short circuits the input of circuit 140 to ground 154 and thereby change the state of the flip-flop. This renders the field effect transistors 130 and 132 non-conductive and conductive respectively so that the motors M1 and M2 operate as the leading and trailing motors respectively.

During a stand-by condition when the circuit of FIG. 5 is energized but the ribbon 28 is to remain at rest, the stand-by switch 150 is closed, thereby grounding both transistors 130 and 132 via the buffers 148 and 146 respectively. This renders both transistors 130 and 132 non-conductive, allowing the motors M1 and M2 to remain at rest.

The junction 159 between the motor M2 and the transistor 134 is coupled to ground through a transistor 160 and a resistor 162. Likewise the junction 163 between the motor M1 and the transistor 136 is coupled to ground through a transistor 164 and the resistor 162. When the motor M2 is coupled to act as the leading motor, the transistor 134 provides current to the motor M2 and the transistor 160 is biased to have little or no effect. Under certain conditions the transistor 164 conducts to provide a substantial amount of negative current to the trailing motor M1 and a corresponding voltage drop across the transistor 162. Similarly, when the motor M1 is acting as the leading motor, the transistor 164 has little or no effect but the transistor 160 is biased to provide a relatively large amount of negative current to the trailing motor M2 and thereby a voltage drop across the resistor 162. If the ribbon 28 becomes jammed, the leading motor M2 or M1 stalls and provides a large current to the resistor $R_C$. The trailing motor M1 or M2 effectively tries to push the ribbon 28 forward, resulting in a large negative current via the associated one of the transistors 160 and 164 and thereby a very large voltage drop across the resistor 162. This voltage drop which is compared by a differential amplifier coupled to operate as a voltage comparator circuit 165 with the voltage at a voltage divider 166 exceeds the voltage from the divider 166 so as to cause the output of the circuit 165 to become low and thereby signal a jam condition. During normal operation the voltage drop across the resistor 162 is less than that provided by the divider 166 so that the output of the voltage comparator circuit 165 is high.

The voltage drop across the resistor $R_C$ is compared with the voltage drop across a resistor 170 by a differential amplifier coupled to operate as a voltage comparator circuit 172. If the driving hub within one of the reels 30, 31 is loose such that the associated reel 30 or 31 is not driven, the absence of torque at the motor M1 or M2 results in very little current flow through the motor M1 or M2 and a reduction in the voltage drop across the resistor $R_C$. If the voltage drop across the resistor $R_C$ becomes less than the drop across the resistor 170, the output of the voltage comparator circuit 172 becomes low so as to signal a loose hub condition. When the condition is corrected the voltage drop across the resistor $R_C$ becomes greater than the drop across the resistor 170 and the output of the voltage comparator circuit 172 again becomes high. Also, when the system is first started up, a reset switch 174 is momentarily closed so as to ground the resistor 170 and force the output of the voltage comparator circuit 172 to be high. Upon release of the reset switch 174 the circuit 172 remains in this state unless there is a loose hub problem.

A third differential amplifier coupled to operate as a voltage comparator circuit 180 is coupled to compare a reference voltage with the voltage at the junction between a pair of resistors 181 and 182 coupled across the motors M1 and M2 and forming a voltage divider network. During normal operation the voltages of the motors M1 and M2 are sufficiently different so that the voltage at the junction between the resistors 181 and 182 is less than that of the reference, causing the output of the circuit 180 to remain high. If the ribbon 28 breaks or a run-away condition is otherwise caused, the voltages of the motors M1 and M2 tend to equalize and the voltage of the junction between the resistors 181 and 182 increases in value to a point where it causes the output of the voltage comparator circuit 180 to become low, thereby signaling a run-away condition.

It will be appreciated by those skilled in the art that various advantages are realized by ribbon drive systems in accordance with the invention. Ribbon drives constructed and tested in accordance with the invention have shown the ribbon 28 to be driven at a constant speed within a tolerance of ±6%, for ribbon pack changes of 2:1 on the reels 30 and 31 without the need for tachometers or other speed sensing means. Ribbon life is enhanced by running the ribbon 28 at a constant speed which produces uniform wear throughout the length of the ribbon 28. The printing itself has been found to be more uniform, apparently due among other things to the fact that the ribbon speed can be held within the required tolerance to move the ribbon 28 fast enough in a direction opposite the shuttle mechanism 22 to minimize overlapping of adjacent dots on the ribbon surface and not too fast to be close to the speed of the shuttle mechanism 22 when the ribbon 28 is moving in the same direction as the shuttle mechanism 22. Ribbon tension is maintained constant within a tolerance of ±10% for changes in the ribbon packs of 2:1 without the need for tension sensors. Ribbon guiding is less critical since ribbon tension can be controlled within limits required for good guiding. The system itself includes two identical motors M1 and M2 operated by identical servo circuits 124 such that the motor functions can be interchanged when ribbon direction is reversed. In this way the leading motor can always function as the drive motor determining ribbon speed and the trailing motor can function as a torque motor to determine ribbon tension. An interlock signal is provided which indicates broken or unsecured ribbon 28, an unsecured reel 30 or 31 or a stalled motor M1 or M2. Where desired, ribbon tension can be increased when the ribbon 28 is at rest, thereby minimizing the chance of the ribbon 28 contacting and smudging the paper 10. Ribbon 28 speed and tension are independent of line voltage variations because of the use of the servo drive. The DC motors M1 and M2 are of low inertia and have a fast enough response to properly ascertain tension during ribbon reversal.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A system for driving an elongated web member comprising the combination of:

a pair of rotatable reel members;

an elongated web member extending between and having the opposite ends thereof wound on opposite ones of the pair of rotatable reel members;

a pair of direct current permanent magnet motors, each coupled to a different one of the pair of rotatable reel members; and circuit means coupled to the pair of motors, the circuit means being operative to energize the motors so as to maintain a substantially constant tension on the web member and including common junction means coupled to each of the pair of motors, means coupled to one of the pair of motors operating as a web member takeup motor for providing a current therethrough and a resulting voltage drop thereacross, means responsive to the voltage drop across said one of the pair of motors for providing a current through the other one of the pair of motors operating as a web member supply motor and into the common junction means and being of sufficient value to maintain the voltage drop across said one of the pair of motors substantially constant, the other one of the pair of motors being operated in response to the voltage drop across said one of the pair of motors, a common current path coupled to each of the pair of motors via the common junction means, a first source of constant voltage coupled to said one of the pair of motors, a second source of constant voltage, differential amplifier means having an output coupled to the other one of the pair of motors and a pair of inputs, one input of which is coupled to the second source of constant voltage, and a feedback circuit coupled between the common current path and the other one of the pair of inputs of the differential amplifier means.

2. A system for driving an elongated web member comprising the combination of:

a pair of rotatable reel members;

an elongated web member extending between and having the opposite ends thereof wound on opposite ones of the pair of rotatable reel members;

a pair of DC motors, each coupled to a different one of the pair of rotatable reel members; and circuit means coupled to the pair of DC motors to energize the DC motors and including common junction means, a pair of constant voltage sources, a pair of servo circuits, each of which includes a different one of the pair of DC motors and is coupled between the common junction means and a different one of the pair of constant voltage sources and is operative when actuated to produce a current through the included DC motor which maintains the voltage at the common junction means substantially constant, and means for alternately actuating the pair of servo circuits, and wherein each of the pair of DC motors has a pair of terminals and each servo circuit includes a differential amplifier having an output coupled to one of the pair of terminals of the included DC motor and a pair of inputs, one input of which is coupled to one of the pair of constant voltage sources, means coupling the other one of the pair of terminals of the included DC motor to the common junction means, first resistor means coupled between the common junction means and the other one of the pair of inputs of the differential amplifier, and second resistor means coupled between the output and the other one of the pair of inputs of the differential amplifier.

3. The invention defined in claim 2, wherein the circuit means includes a voltage divider network coupled between the other one of the pair of terminals of each of the pair of DC motors and means responsive to a change in voltage in the voltage divider network by a predetermined amount for signaling a run-away condition for the elongated web member.

4. The invention defined in claim 2, wherein the circuit means includes a pair of transistors, each of which is coupled to the one of the pair of terminals of a different one of the pair of DC motors, a reference terminal, resistor means coupled between the reference terminal and each of the pair of transistors, and means responsive to a voltage of selected value across the resistor means for signaling a jam condition for the elongated web member.

5. A system for driving an elongated web member comprising the combination of;

a pair of rotatable reel members;

an elongated web member extending between and having the opposite ends thereof wound on opposite ones of the pair of rotatable reel members;

a pair of DC motors, each coupled to different one of the pair of rotatable reel members; and circuit means coupled to the pair of DC motors to energize the DC motors and including common junction means, a pair of constant voltage sources, a pair of servo circuits, each of which includes a different one of the pair of DC motors and is coupled between the common junction means and a different one of the pair of constant voltage sources and is operative when actuated to produce a current through the included DC motor which maintains the voltage at the common junction means substantially constant, and means for alternately actuating the pair of servo circuits, and wherein the circuit means includes means responsive to an increase in voltage at the common junction means for signaling a run-away condition for the elongated web member.

6. A system for driving an elongated web member comprising the combination of;

a pair of rotatable reel members;

an elongated web member extending between and having the opposite ends thereof wound on opposite ones of the pair of rotatable reel members;

a pair of DC motors, each coupled to a different one of the pair of rotatable reel members; and circuit means coupled to the pair of DC motors to energize the DC motors and including common junction means, a pair of constant voltage sources, a pair of servo circuits, each of which includes a different one of the pair of DC motors and is coupled between the common junction means and a different one of the pair of constant voltage sources and is operative when actuated to produce a current through the included DC motor which maintains the voltage at the common junction means substantially constant, and means for alternately actuating the pair of servo circuits, and wherein the circuit means includes means responsive to a decrease in voltage at the common junction means for signaling a loose hub condition for the elongated web member.

7. A system for driving an elongated web member comprising the combination of:

a pair of rotatable reel members;

an elongated web member extending between and having the opposite ends thereof wound on opposite ones of the pair of rotatable reel members;

a pair of DC motors, each coupled to a different one of the pair of rotatable reel members; and circuit means coupled to the pair of DC motors to energize the DC motors and including common junction means, a pair of constant voltage sources, a pair of servo circuits, each of which includes a different one of the pair of DC motors and is coupled between the common junction means and a different one of the pair of constant voltage sources and is operative when actuated to produce a current through the included DC motor which maintains the voltage at the common junction means substantially constant, and means for alternately actuating the pair of servo circuits, and wherein the circuit means includes means responsive to a decrease in the voltage in either one of the pair of servo circuits at the side of the included DC motor opposite the common junction means for signaling a jam condition for the elongated web member.

8. In an impact printer system, the combination of:

a platen;

means for disposing a printable medium against the surface of the platen;

an elongated ink ribbon having a portion thereof disposed adjacent and on the opposite side of the printable medium from the platen;

a hammer bank mechanism mounted adjacent said portion of the ribbon on the opposite side of the ribbon from the printable medium and the platen, the hammer bank mechanism being capable of undergoing reciprocating motion relative to the printable medium and the platen and including a plurality of hammers for impacting the ribbon and the printable medium against the platen;

a pair of rotatable reels receiving the opposite ends of the ribbon, the amounts of the ribbon wound around the reels defining ribbon packs which vary in complementary fashion;

a pair of motors, each being coupled to a different one of the pair of reels; and means coupled to the pair of motors for energizing the motors to drive the ribbon between the pair of reels at substantially constant speed and substantially constant tension independent of varying ribbon packs on the pair of reels, said means including constant voltage source means coupled to each of the pair of motors, common junction means coupled to each of the pair of motors opposite the constant voltage source means and a pair of servo circuits, each of which is coupled to a different one of the pair of motors and to the common junction means and is operative to be activated only when the motor to which the servo circuit is coupled is acting as a supply reel motor and to cause a current to flow through the motor to which the servo circuit is coupled and into the common junction means to maintain the voltage at the common junction means substantially constant, and wherein the motors comprise DC permanent magnet motors and the means for energizing includes means for maintaining the sum of currents through the pair of motors substantially constant.

9. The invention defined in claim 8, wherein each of the servo circuits comprises a differential amplifier having an output coupled to one of the pair of motors, a first input coupled to the constant voltage source means and a second input coupled in a feedback circuit to the output and to the common junction means.

10. An arrangement for driving a pair of ribbon holding reels in an impact printer, the reels having a determinable torque-speed characteristic which will produce substantially constant ribbon speed and tension, the arrangement comprising:

a pair of motors, each being operative to drive a different one of a pair of reels in the impact printer and having a torque-speed characteristic substantially like a torque-speed characteristic which will produce substantially constant ribbon speed and tension in the impact printer; and means coupled to the pair of motors to energize the motors and including common junction means coupled to each of the pair of motors, means for providing a first current through a first one of the pair of motors chosen to operate as a takeup motor, the first current flowing through the first motor and the common junction means from a first constant voltage source and providing a given voltage drop across the first motor, and means for providing a second current through a second one of the pair of motors chosen to operate as a supply motor, the second current being determined by the voltage at the common junction means, the second current flowing through the second motor and the common junction means and maintaining the voltage at the common junction means substantially constant and thereby the given voltage drop across the first motor constant, the means for providing a first current comprising the first source of constant voltage coupled to the first motor opposite the common junction means and the means for providing a second current comprising a second source of constant voltage and a servo circuit coupled between the second source of constant voltage and the second motor and operative to vary current through the second motor in accordance with the voltage at the common junction means to maintain the voltage at the common junction means substantially constant.

11. An arrangement for driving a pair of ribbon holding reels in an impact printer, the reels having a determinable torque-speed characteristic which will produce substantially constant ribbon speed and tension, the arrangement comprising:

a pair of motors, each being operative to drive a different one of a pair of reels in the impact printer and having a torque-speed characteristic substantially like a torque-speed characteristic which will produce substantially constant ribbon speed and tension in the impact printer; and means coupled to the pair of motors to energize the motors and including common junction means coupled to each of the pair of motors, means for providing a first current through a first one of the pair of motors chosen to operate as a takeup motor, the first current flowing through the first motor and the common junction means from a first constant voltage source and providing a given voltage drop across the first motor, and means for providing a second current through a second one of the pair of motors chosen to operate as a supply motor, the second current being determined by the voltage at the common junction means, the second current flowing through the second motor and the common junction means and maintaining the voltage at the common junction means substantially constant and thereby the given voltage drop across the first motor constant, the motors comprising DC motors and the means coupled to energize the pair of DC motors comprising the first constant voltage source and a second constant voltage source, a common current path coupled to the common junction means, means coupling one of the pair of DC motors between the common current path and the first constant voltage source and servo means coupling the other one of the pair of DC motors between the common current path and the second constant voltage source, the servo means being operative to produce sufficient current in the other one of the pair of DC motors so as to maintain the voltage at the common current path substantially constant.

12. The invention defined in claim 11, wherein the servo means comprises a differential amplifier having an output coupled to the other one of the pair of DC motors and a pair of inputs, one input of which is coupled to the second constant voltage source, first resistor means coupled between the common current path and the other one of the pair of inputs of the differential amplifier and second resistor means coupled between the output and the other one of the pair of inputs of the differential amplifier.

13. An arrangement for driving a pair of ribbon holding reels in an impact printer so as to maintain substantially constant ribbon speed and tension comprising:

first and second DC motors, each having first and second terminals and operative to drive a different one of a pair of reels in an impact printer;

a common terminal coupled to the first terminal of each of the first and second DC motors;

a common voltage reference;

a common resistor coupled between the common terminal and the common voltage reference;

first and second sources of constant voltage;

first and second differential amplifiers, each having an output terminal and a pair of differential input terminals, one of the differential input terminals of the first differential amplifier being coupled to the first source of constant voltage, one of the differential input terminals of the second differential amplifier being coupled to the second source of constant voltage, and the output terminals of the first and second differential amplifiers being coupled to the second terminal of the first and second DC motors respectively;

first and second feedback resistances coupled between the output terminal and the other one of the pair of differential input terminals of the first and second differential amplifiers respectively;

first and second input resistances coupled to the other one of the pair of differential input terminals of the first and second differential amplifiers respectively; and first and second switches coupled between the common terminal and the first and second input resistances respectively.

14. The invention defined in claim 13, wherein each of the first and second switches comprises a field effect transistor having a gate terminal, and further including means for alternately grounding one or the other of the gate terminals of the field effect transistors comprising the first and second switches in response to external direction commands.

15. The invention defined in claim 14, further including means for grounding both gate terminals of the field effect transistors comprising the first and second switches in response to an external stand-by command.

16. The invention defined in claim 13, further including a pair of resistors serially coupled between the second terminals of the first and second DC motors and means coupled between the pair of resistors and responsive to an increase in the voltage between the pair of resistors by a selected amount for providing a run-away signal.

17. The invention defined in claim 13, further including a pair of first transistors, each of which is coupled between the second terminal of a different one of the first and second DC motors and the output of the first and second differential amplifiers respectively, a second resistor coupled to the common voltage reference, a pair of second transistors, each of which is coupled between a different one of the pair of first transistors and the second resistor, and means coupled to the second resistor and responsive to an increase in the voltage drop across the second resistor by a selected amount for providing a jam signal.

18. The invention defined in claim 13, further including means coupled to the common terminal and responsive to a drop in the voltage thereat for providing a loose hub signal.

* * * * *